US006810614B2

(12) United States Patent
Phillips et al.

(10) Patent No.: US 6,810,614 B2
(45) Date of Patent: Nov. 2, 2004

(54) DEVICES, APPARATUSES AND METHODS FOR MOUNTING ACCESSORIES TO WEAPONS INCLUDING A SCENT GENERATING DEVICE

(76) Inventors: Alphonse E. Phillips, 901 Long Pond Rd., Plymouth, MA (US) 02360; Antonio J. Duarte, One Winterberry Rd., Lincoln, RI (US) 02865

( * ) Notice: Subject to any disclaimer, the term of this patent is extended or adjusted under 35 U.S.C. 154(b) by 0 days.

(21) Appl. No.: 10/144,653

(22) Filed: May 13, 2002

(65) Prior Publication Data

US 2003/0000123 A1 Jan. 2, 2003

Related U.S. Application Data

(60) Provisional application No. 60/290,580, filed on May 14, 2001.

(51) Int. Cl.[7] ..... F41D 21/00
(52) U.S. Cl. ..... 42/75.02; 42/75.01
(58) Field of Search ..... 42/75.01, 75.02

(56) References Cited

U.S. PATENT DOCUMENTS

| | | | | | |
|---|---|---|---|---|---|
| 1,088,314 | A | * | 2/1914 | Wilcke | 42/85 |
| 1,341,117 | A | | 5/1920 | Fischer | 42/94 |
| 2,664,659 | A | | 1/1954 | Parker | 42/94 |
| 2,679,707 | A | * | 6/1954 | Merlino | 42/85 |
| 2,696,059 | A | * | 12/1954 | Judd | 42/85 |
| 2,913,960 | A | * | 11/1959 | Harvey et al. | 89/1.815 |
| 2,926,448 | A | | 3/1960 | Stam | 42/71 |
| 3,066,375 | A | * | 12/1962 | Knowles et al. | 24/639 |
| 3,226,872 | A | * | 1/1966 | Pachmayr | 42/85 |
| 3,292,264 | A | | 12/1966 | Kincannon | 33/50 |
| 3,427,102 | A | | 2/1969 | Wade | 352/95 |
| 3,733,727 | A | | 5/1973 | Jones et al. | 42/1 |
| 3,750,318 | A | | 8/1973 | Burris | 42/1 |
| 3,861,070 | A | * | 1/1975 | Wild et al. | 42/85 |
| 3,875,694 | A | * | 4/1975 | Wild | 42/73 |
| 3,876,078 | A | | 4/1975 | Gomes et al. | 211/64 |
| 3,877,166 | A | * | 4/1975 | Ward | 42/127 |
| 4,024,997 | A | * | 5/1977 | Kolpin | 224/584 |
| 4,309,095 | A | | 1/1982 | Buckley | 354/81 |
| 4,328,624 | A | | 5/1982 | Ross | 33/245 |
| 4,494,328 | A | | 1/1985 | Stevens | 42/1 |
| 4,523,717 | A | | 6/1985 | Schwab | 239/56 |
| 4,641,451 | A | * | 2/1987 | Harris | 42/85 |
| 4,756,111 | A | * | 7/1988 | Lapier | 42/128 |
| 4,771,563 | A | * | 9/1988 | Easley | 43/1 |
| 4,788,787 | A | * | 12/1988 | Konietzki | 43/1 |
| 4,986,019 | A | | 1/1991 | Dennis, Jr. | 42/69.01 |
| 5,035,390 | A | | 7/1991 | Sanders | 248/231 |
| 5,074,188 | A | | 12/1991 | Harris | 42/85 |
| 5,092,071 | A | * | 3/1992 | Moore | 42/85 |
| 5,303,496 | A | * | 4/1994 | Kowalkowski | 43/1 |
| 5,307,584 | A | | 5/1994 | Jarvis | 43/1 |
| 5,685,103 | A | | 11/1997 | Wiggins | 42/94 |
| 5,711,104 | A | | 1/1998 | Schmitz | 42/100 |

(List continued on next page.)

FOREIGN PATENT DOCUMENTS

| | | |
|---|---|---|
| AT | 20798 | 7/1905 |
| DK | 92245 | 11/1961 |

*Primary Examiner*—Michael J. Carone
*Assistant Examiner*—L. Semunegus
(74) *Attorney, Agent, or Firm*—William J. Daley, Jr.; Edwards & Angell, LLP

(57) ABSTRACT

The present invention features devices for mounting accessories to a weapon and more particularly mounting devices that allow one or more accessories to be secured to the weapon, such as a firearm and crossbow, at the same time using the same mounting device. In more particular embodiments, one of a scent generating device, a weapon hanger, a recording device and/or an illumination device, such as a flashlight is secured to the device and thus to the weapon. The present invention also features methods related thereto including methods for masking the scent of a hunter and hunting.

12 Claims, 6 Drawing Sheets

U.S. PATENT DOCUMENTS 5,787,630 A * 8/1998 Martel ..... 42/125
5,887,375 A 3/1999 Watson ..... 42/106
6,070,355 A 6/2000 Day ..... 42/106
6,086,031 A * 7/2000 Renfro ..... 248/218.4
6,115,952 A 9/2000 Rigler ..... 42/103
6,134,823 A * 10/2000 Griffin ..... 42/105
6,192,614 B1 2/2001 Cliburn ..... 42/106
6,289,621 B1 9/2001 Vendetti et al. ..... 42/86

* cited by examiner

DEVICES, APPARATUSES AND METHODS FOR MOUNTING ACCESSORIES TO WEAPONS INCLUDING A SCENT GENERATING DEVICE

This application claims the benefit of U.S. Provisional Application Ser. No. 60/290,580 filed May 14, 2001, the teachings of which are incorporated herein by reference for all purposes.

FIELD OF INVENTION

The present invention relates generally to accessories for firearms, more particularly to devices, apparatuses and methods for efficiently mounting accessories to firearms and more specifically to devices, apparatuses and methods for efficiently mounting accessories as well as providing a mechanism for generating a scent.

BACKGROUND OF THE INVENTION

The general concept of attaching accessories to firearms is known in the art. Early concepts for attaching accessories involved the use of the bayonet mount that is usually on and at the end of the barrel of the firearm alone or in combination with additional structure. Federal laws have been enacted, however, that effectively restricts bayonet mounts to only weapons that are employed by the military or law enforcement authorities.

Other concepts involved the use of a plurality of bands or ring clamps or other structures that may block or otherwise interfere with the firearm's aiming sights, thereby preventing the aiming sights from been properly used for aiming the firearm during the daytime. Such bands, clamps or other structures tend to make the firearm unnecessarily heavier and more awkward to use. Consequently, these bands, clamps, devices or other structures are removed from the weapon at times other than when the accessory is to be used.

In one particular hunting application, the hunter is located in a tree stand or hunting blind. In order to get into the tree stand, the hunter has to climb the tree using tree branches or a temporary or permanent ladder type arrangement. In some cases, the hunter hands the weapon or firearm up to another person already in the tree stand. There have been cases where the firearm was accidentally discharged as the weapon was being handed to the other person causing injury or death to the person the weapon was being handed to. In other cases, the firearm has slipped out of the hunter's hand while climbing and fallen to the ground, whereby the firearm is damaged and/or accidentally discharged again creating the risk of grievous injury. In addition, the hunter may place the firearm in their lap while the hunter is in the tree stand for any of a number of reasons including the cold temperature of the air. There have been occasions where the firearm has slipped out of the hunter's lap and fallen to the ground, resulting in damage or accidentally discharging of the weapon.

Because the locations where such accidents can occur are typically remote from areas serviced by conventional normal emergency medical personnel, there can be delays in obtaining medical assistance and consequently increasing the severity and consequences of the injury. Thus, there continues to be a need to develop hunting techniques and devices to minimize the risk of injury to hunters and bystanders resulting from the accidental discharging of a falling weapon.

It also has become desirous to make recordings or movies of one's hunting experience. As a practical matter it is extremely difficult for a hunter to target the quarry, be it deer, turkey, flying ducks, flying geese, pheasant, etc. as well as focusing the camera using the camera's rearview finder so the camera is viewing the target/area including the target (e.g., switching back and forth between the aiming sights and the view finder). Consequently, another person typically operates the camera or recording device to make the recording without, in some cases, the knowledge of what quarry the hunter is actually targeting. It thus would be desirous to improve upon existing techniques so the hunter can target and record at the same time without involving another hunter or bystander.

While hunting, it is a common practice to hide or mask the smell or odor of the hunter with an animal scent or musk such as, for example, deer urine. The conventional technique is to apply the animal scent on the hunter's boots or hat, wearing a scent button or pad on one's clothing or hanging the button or pad off of one's self. Consequently, the hunter's clothing or shoes retains the odor of the scent, which is not desirable when the hunter returns home. Alternatively, a scent generating device or other mechanism is hung off or tied to the tree proximal the hunter or the tree-stand (e.g., see U.S. Pat. No. 4,523,177). Such a technique is limited essentially to those cases where the hunter intends to remain at a specific location and not move around as well as requiring the hunter to carry such a device/mechanism to the tree stand, hunting blind, etc.

It thus would be desirable to provide a new device(s) that can be attached to a firearm and that can be used to at least one of generate a masking scent, hang a firearm and/or to record or make movies of the hunting experience as well as methods related thereto. It would be particularly desirable to provide such a device and method that would not interfere with the firearm's aiming sights when the device is attached to the firearm so the device need not be detached and re-attached from the firearm/weapon particularly when in the field. It also would be desirable to provide such a device that would make the firearm less awkward when it is attached thereto use as compared to prior art devices. Such device s preferably would be simple in construction and less costly than prior art devices and such methods would not require highly skilled users to utilize the device.

SUMMARY OF THE INVENTION

The present invention features devices for mounting accessories to a weapon and more particularly mounting devices that allow more than one accessory to be secured to the weapon, such as a firearm (e.g., rifle, shotgun) or a crossbow, at the same time using the same mounting device. In more particular embodiments, the mounting device secures one of a scent generating device, a weapon hanger, a recording device and/or an illumination device, such as a flashlight to the device and thus to the weapon. The present invention also features methods related thereto-including methods for masking the scent of a hunter and for hunting methods.

According to one aspect of the present invention, there is featured an accessory mounting device that includes a clamping device that is configured and arranged so as to be removably secured to a portion of a weapon. The clamping device is configured and arranged so an accessory for the weapon is secured thereto. In more particular embodiments, the accessory is one of a scent generating mechanism, a weapon hanger, a recording device or an illumination device and the clamping device is configured and arranged so as to not interfere with the aiming sights of the weapon when it is secured thereto. In more specific embodiments, a plurality or more of such accessories are secured to the clamping device at the same time.

In other particular embodiments of the present invention, the accessory is a weapon hanger, where the weapon hanger comprises first, second and third segments being interconnected to each other. The second segment is arcuate and the first, second and third segments are configured and arranged to form a hook like structure. In a more specific embodiment, the second and third segments are formed and arranged so a long axis of the third segment intersects a long axis of the first segment. More particularly, the angle of intersection is in the range of from about 10 degrees to about 20 degrees, more specifically 15 degrees. In a particularly preferred embodiment, the weapon hanger also is configurable so as the scent generating mechanism, such as a scent pad is attached to a portion thereof.

According to another aspect of the present invention there is featured a method for masking human scent while hunting, including securing a scent generating mechanism to a weapon; and dispensing scent from the scent generating mechanism. In more particular embodiments such securing includes securing a mount to the weapon; and securing the scent generating mechanism to the mount. In an exemplary embodiment, the scent generating mechanism comprises an absorbent material that retains the scent material, more particularly absorbent material in the form of a pad. In further exemplary embodiments, the scent generating mechanism includes an oleophillic absorbent material and the method further includes applying scent material to the absorbent material/oleophillic absorbent material.

In yet another aspect of the present invention there is featured a method for hunting including securing a mounting device to a portion of a hunting weapon; removably securing a scent generating mechanism to the mounting device; and dispensing scent from the scent generating mechanism so as to mask the human scent. Such a method also further features any of hanging the weapon using a weapon hanger secured to the mounting device, recording scenes using a recording device secured to the mounting device and illuminating a target area using an illumination device secured to the mounting device.

Other aspects and embodiments of the invention are discussed below.

BRIEF DESCRIPTION OF THE DRAWING

For a fuller understanding of the nature and desired objects of the present invention, reference is made to the following detailed description taken in conjunction with the accompanying drawing figures wherein like reference character denote corresponding parts throughout the several views and wherein.

DESCRIPTION OF THE PREFERRED EMBODIMENT

Figure 3A:
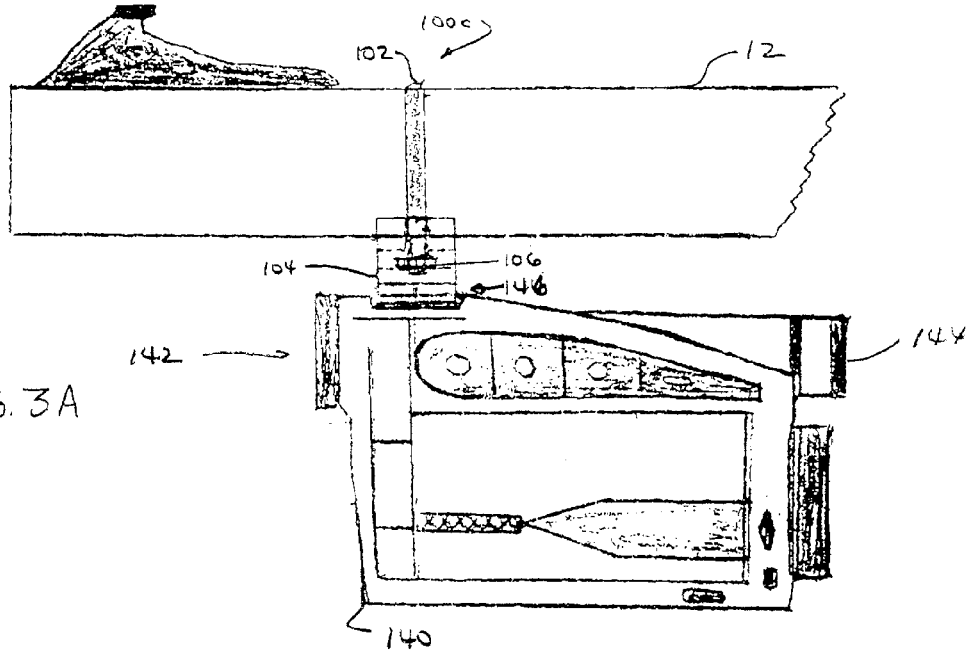
FIG. 3A is yet another schematic view of a mounting device according to the present invention with a recording device secured thereto.
Figure 3B:
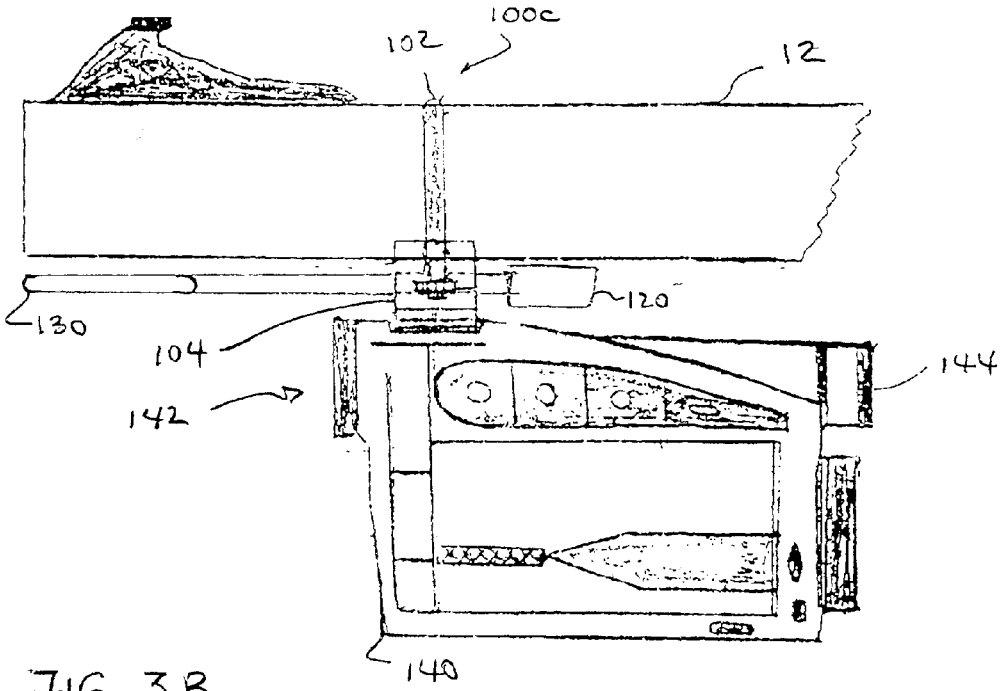
FIG. 3B is a schematic view of the mounting device of FIG. 3A with multiple accessories including a recording device secured thereto.
Figure 4B:
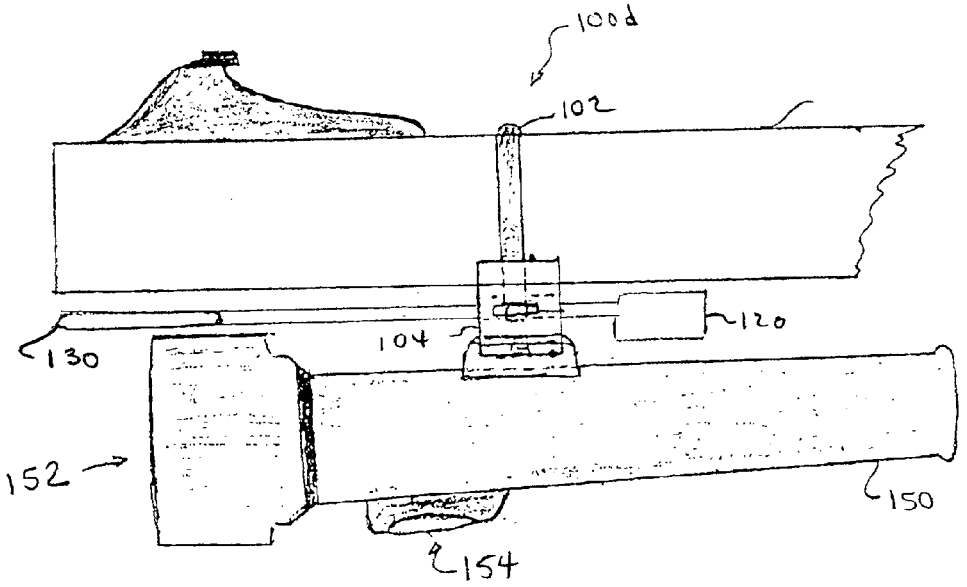
FIG. 4B is a schematic view of the mounting device of FIG. 4A with multiple accessories including an illumination device (e.g., a flashlight) secured thereto.
Figure 4A:
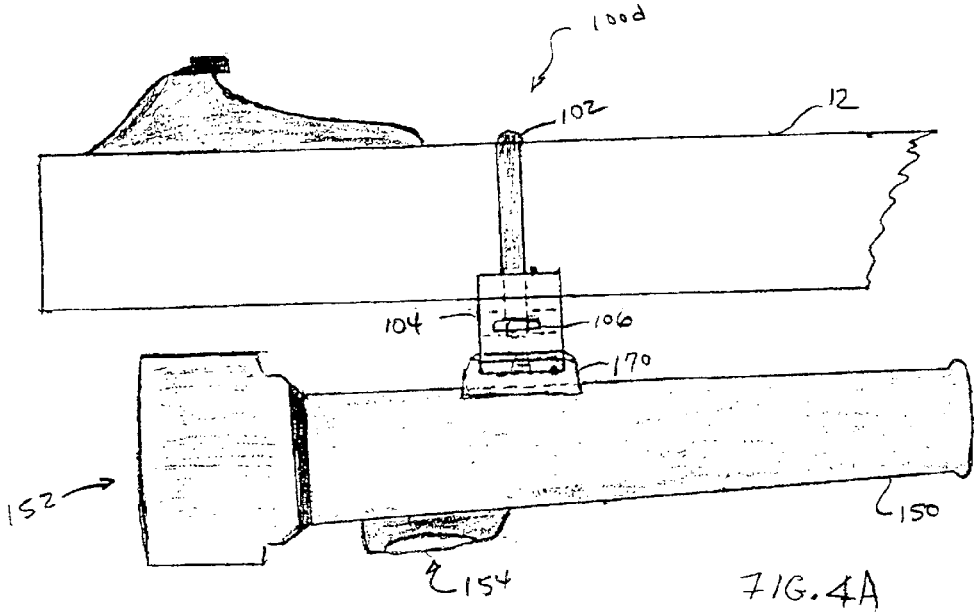
FIG. 4A is still another schematic view of a mounting device according to the present invention with an illumination device (e.g., a flashlight) secured thereto.
Figure 10A:
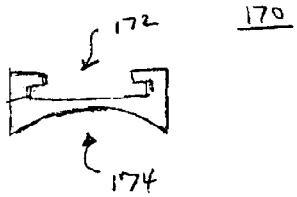
FIG. 10A is a front view of an exemplary adapter member for securing a flashlight to the body member.
Figure 10B:
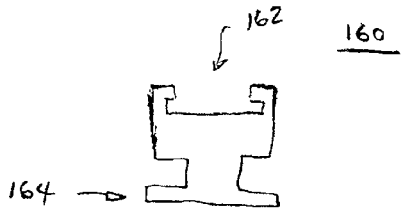
FIG. 10B is a front view of an exemplary adapter member for securing a recording device to the body member.

Referring now to the various figures of the drawing wherein like reference characters refer to like parts, there is shown in FIGS. 1–2, 3A and 4A a mounting device 100*a–d* according to the present invention being secured to a portion of the barrel 12 of a firearm 10 (FIG. 10), which mounting device is further particularly configured for use with: a scent pad 120 (FIG. 1), a weapon hanger 130 alone or in combination with a scent pad (FIG. 2), a recording device 140 (FIG. 3A) and/or an illumination device 150, such as a flashlight (FIG. 4A). The foregoing is illustrative of a few accessories and/or uses that can be made off such a mounting device, however, these illustrations are not exhaustive of all possible accessories and uses a weapon mounting device 100*a–d* according to the present invention can be put to. It also should be recognized, that it is within the scope of the present invention for such a mounting device 100*a–d* to the configured and arranged so a plurality of accessories or devices can be secured to the mounting device at the same time. For example, in illustrative embodiments a scent pad 120, a weapon hanger 130 and one of a recording device 140 or an illumination device 150 are secured to a mounting device 100*c*, 100*d* as shown in FIGS. 3B and 4B respectively.

Figure 11:
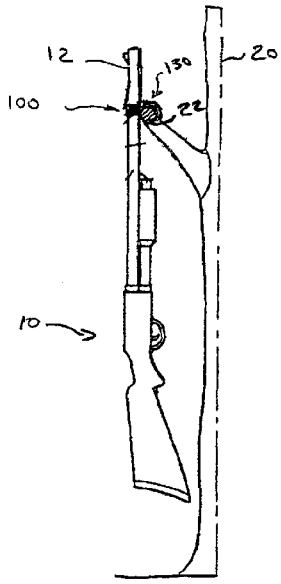
FIG. 11 is an illustrative view of a firearm hanging from a tree branch, where a mounting device having a weapon hanger is secured to the barrel of the firearm.

Now referring to FIG. 1 and FIGS. 5–7, there is shown a mounting device 100*a* that is configured so as to be removable attached or secured to a portion of the weapon and configured so that a scent pad 120 also is removably attached thereto. The mounting device 100*a* includes a clamp member 102 and a base member 104 that are arranged so as to generally form an aperture there between in which is received the portion of the weapon, which in the illustrated embodiment is the barrel 12 of the gun 10 (FIG. 11). As more particularly described herein, the clamp member 102 and base member 104 also are configured and arranged so that each are urged against and into mechanical engagement with the barrel 12.

It should be recognized that while a weapon such as firearm having a cylindrical barrel 12, for example a rifle, shotgun or pistol type, is illustrated and although the present invention is particularly suited for such an application, the present invention shall not be limited to only such types of weapons. It is within the scope of the present invention for the clamping member 102 and base member 104 to be adapted and configured for use with weapons that have other than cylindrical barrels (e.g., octagonally shaped barrels) as well as other types of weapons such as cross-bows for example. Other applications and uses of the present invention are described herein.

Figure 5A:
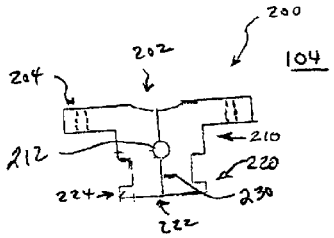
FIGS. 5A,B are front and side views respectively of a body member of the mounting device of any of FIGS. 1–4.
Figure 5B:
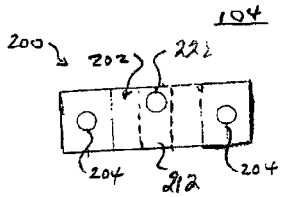

As shown more clearly in FIGS. 5A,B, the base member 104 includes an upper portion 200, a middle portion 210 and lower portion 220. The upper portion 200 includes a depressed region 202 and a plurality of apertures 204 that extend through areas of the upper portion that extend beyond the middle portion 210. The upper portion 200, the middle portion 210 and the low portion 220 are mechanically coupled to each other so as to form a single unified structure.

In an exemplary embodiment, the base member 104 is a single member formed so as to define a structure having these three portions. The base member 104 is made up of any of a number of materials known to those skilled in the art, more particularly materials, such as aluminum, titanium or composite materials, that in exhibit good structural characteristics while being of light weight.

The plurality of through apertures 204 are sized and configured to receive the threaded ends 300 of the clamping member (FIG. 6) therein. Although the through apertures 204 are illustrated as being circular, this shall not be construed as a limitation as the through apertures can be oval so as to allow for lateral misalignment for example as well as any other geometric shape appropriate for the intended use.

In the illustrative embodiment, the depressed region 202 generally forms a partial cylindrical depressed region in which is received a lower portion of the cylindrical barrel 12. The particular configuration of the depressed region 202 is generally established so as to form a three-dimensional shape that complements the particular portion of the weapon to which the depressed region contacts when the base member 104 is secured thereto.

The middle portion 210 includes a through aperture to 12 that extends lengthwise through the middle portion and generally orthogonally to the through apertures 204 in the upper portion. The middle portion through aperture 212 is sized and configured to receive therein the tubular member 110 upon which is mounted in the scent pad 120. Although the middle portion through aperture 204 is illustrated as being circular, this shall not be construed as a limitation as the through aperture can have other geometric shape that is otherwise appropriate for the intended use.

As provided hereinafter, the middle portion through aperture 212 also can be utilized for receiving therein a portion of the weapon hanger 130. In addition, the middle portion through aperture 212 may be dispensed with for those applications in which an accessory is secured to the lower portion 220 as described herein.

The lower portion 220 includes an aperture 222 that extends from the lower surface to the surface of the middle portion through aperture 212. A mechanism is disposed in the low portion aperture 222 that extends into the middle portion through aperture 212 so as to provide a mechanism for generally securing the tubular member 110 to the base member 104. In a particular embodiment, the lower portion aperture 222 is threaded and a threaded member 108 (e.g. a hex screw, a set screw) is threadably received therein, where the threaded member is used for generally securing the tubular member.

Figure 1:
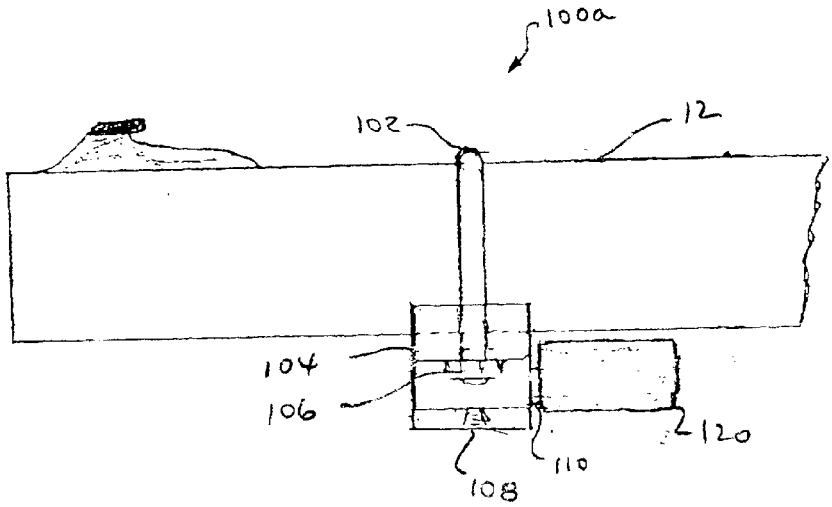
FIG. 1 is a schematic view of a mounting device according to the present invention with a scent pad according to the present invention secured thereto.

In particular embodiments, the base member 104 is configured and arranged so that it can be adapted to perform any of the applications or functions described in connection with FIGS. 1–4. Although such features are illustrated in FIG. 1, they are described hereinafter in connection with one of FIGS. 3–4. It should be recognized, however, that a base member according to the present invention is configurable so as to as exclude such other features so as to yield a base member particularly configured for a specific application.

Figure 6:
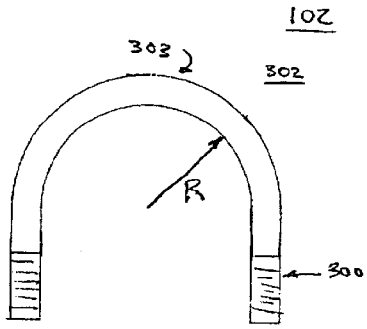
FIG. 6 is a side view of a U-member of the mounting device of any of FIGS. 1–4.

An exemplary embodiment of the clamp member 102 is shown in FIG. 6, which in the illustrated embodiment is a U-shaped member 302 whose terminal ends are threaded ends 300. The clamp member 102 is made up of any of a number of materials known to those skilled in the art, more particularly materials, such as aluminum, titanium or composite materials, that exhibit good structural characteristics while being of light weight.

In the illustrative embodiment, the clamp member 102 is a horseshoe shaped member 302 as this shape generally complements the cylindrical shape of the barrel 12 as well as forming a shape whereby the inner surface or diameter of the horseshoe shaped member 302 mechanically engages the top surface of the barrel. The particular configuration and arrangement of the clamp member 102 is generally established so as to form a three-dimensional shape that complements the particular portion of the weapon to which the clamp member will come into contact with as well as being removably secured to the base member 104, for example, the clamp member can be U-shaped.

Also, while the clamp member 102 is illustrated as a tubular member, the member can be configured and arranged so that all or portions of the clamp member provide a flat surface opposing the weapon and/or are in the shape of flat stock For example, the arcuate portion 303 of the horseshoe shaped member 302 can be shaped, formed or arranged so the surface that opposes the surface of the weapon is generally flat thereby increasing the contact area. Alternatively, the clamp member 102 can be formed so that the portion in contact with the weapon is a generally flat member and the portions passing through upper portion through apertures 204 are generally cylindrically shaped.

As noted above, in the illustrated embodiment the ends 300 of the clamp member 102 are threaded so that the clamp member is removably secured to the base member 104 using any of a number of threaded devices such as nuts 106, wing nuts, stop nuts or nuts with stop washers as are known to those skilled in the art. This shall not constitute a limitation, however, as the clamp member 102 can be secured to the base member using any of a number of techniques known to those skilled in the art so the clamp member and base member mechanically engage the outer surface of the weapon, such as the barrel 12 of a gun. Further, and although in the illustrated embodiment the mounting device 100*a* is removably secured to the weapon, it is within the scope of the present invention for techniques to be used whereby the clamp member 102 is more permanently secured to the base member such as by adhesives.

In the illustrated embodiment, a scent generating mechanism such as the scent pad 120 is configured and arranged so as to be removable secured to the tubular element 110. The scent pad 120 also is configured and arranged so that it can hold scent material of an animal, which scent material is preferably automatically dispensed or given up to the surrounding environment so as to mask the odor or smell of the human hunter and/or bystander.

More particularly, by mounting the scent pad 120 to the weapon, the hunter can dispense or distribute the animal scent to the environment (e.g., air) by moving the gun back and forth or side to side as well as when the hunter is walking forward and/or backwards. Essentially, the movement of the scent pad 120 due to the motion of the weapon and/or the hunter assists in making the scent become airborne. Also, because the weapon is generally disposed in a direction that should be between the quarry and the hunter, the scent is dispensed in way that should mask the smell or odor of the hunter.

In a particular embodiment, the scent pad 120 includes an outer member 122 that is generally configured and arranged to releasably retain the scent material therein and so the scent generated by the scent material can be released therefrom into the atmosphere. Such an outer member 122 includes any of a number of materials known to those skilled in the art that can take up and/or absorb the scent material and allow the scent to become airborne or released to the environment. Such materials include but are not limited to foam materials or other absorbent materials including but not limited to an oleophillic absorbent fabric. Oleophillic fabrics are particularly suited because the material rapidly and efficiently can picks up or absorbs the scent material that is typically in liquid form and typically absorbs many times its own weight. Such oleophillic material also typically takes on the characteristics of the material being absorbed and exhibits good resistance to tearing.

The scent material comprises any of a number of materials known to those skilled in the hunting arts for generating scents of animals. In an exemplary embodiment, the scent material comprises animal urine such as deer urine.

In addition, the scent pad also is configured to include an inner member 124, where the outer and inner members 122, 124 are formed so they are mechanically engaged with each other so as to form an unified structure. The inner member 124 includes an aperture 125 therein which extends along the length of the scent pad 120 and in which aperture is received the tubular member 110. The inner member aperture 125 is sized and configured so the scent pad is removably secured to the exposed end 114 of the tubular member 110 when the tubular member is secured to the mounting device 100*a*. More specifically, the inner member aperture 125 is sized and configured so that it should not fall off as the weapon is moved about or be easily removed while hunting, however, the scent pad 120 should be capable of being removed by the hunter without the need for special tools.

Figure 7A:
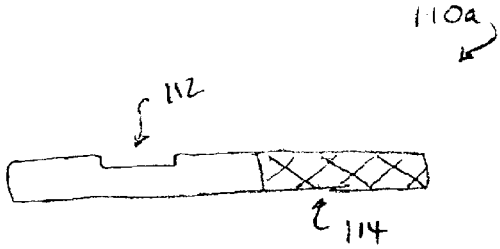
FIGS. 7A,B are side views of two embodiments of a scent pad mounting member.
Figure 7B:
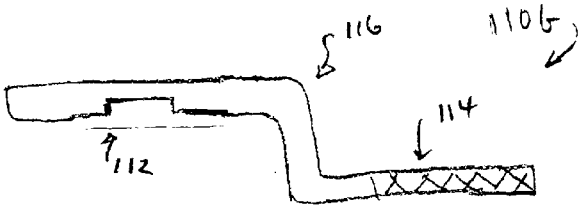
Figure 8A:
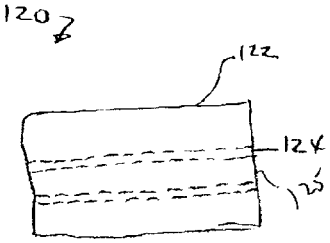
FIGS. 8A,B are plan and end views of an exemplary scent pad according to the present invention.
Figure 8B:
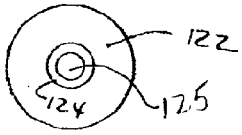
Figure 2:
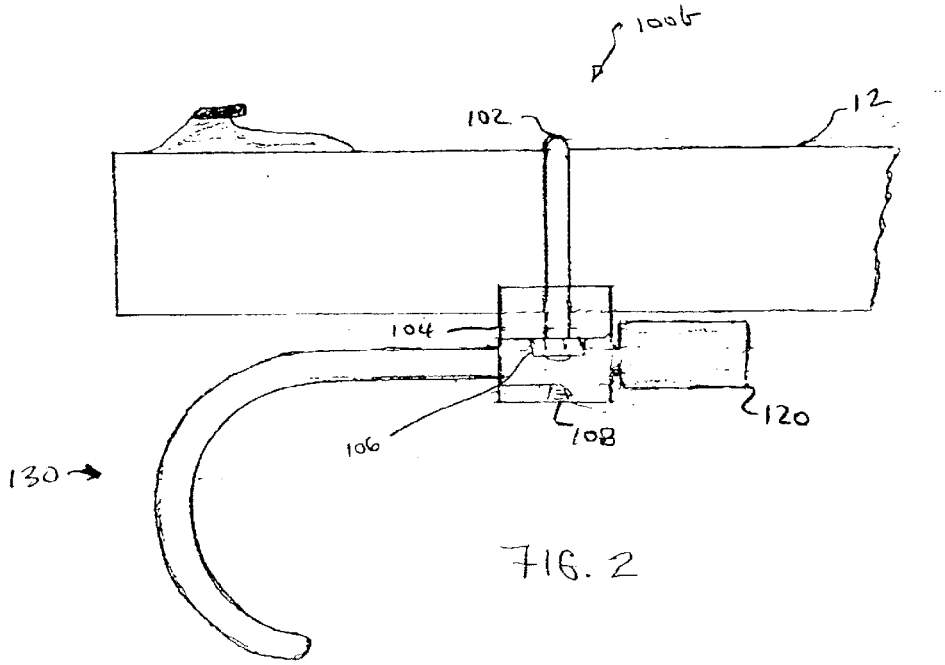
FIG. 2 is another schematic view of a mounting device according to the present invention with a weapon hanger secured thereto and a scent pad secured to the weapon hanger.

There is shown in FIGS. 7A,B two exemplary illustrative embodiments of a tubular element 110*a,b* to which is secured the scent pad 120 and which tubular element also is secured to the mounting device 100*a*. In one embodiment, and as shown in FIG. 7A, the tubular element 110*a* is substantially straight or extends along a long axis for its entire length. There is provided a notch 112 in at least one side of the tubular member 110*a* or the notch may be configured so to extend about a substantial portion or the entire circumference of the tubular member. As described herein, the notch 112 is used for securing the tubular element within the base member 104.

The end of the tubular member 110*a* opposite the notch 112, the exposed end 114, to which is secured the scent pad is preferably configured with any of a number of mechanisms or surface artifacts known to those skilled in the art, such as knurling, for purposes of increasing mechanical engagement between the tubular member 110*a* and the surface of the inner member aperture 125.

In an alternative embodiment, the tubular member 110*b* includes an offset 116 so that the scent pad 120 is displaced a distance from the notched end of the tubular member 110*b*. In this way, for example, the scent pad 120 can be positioned further away from or closer to the weapon than would be possible with the essentially straight tubular member of FIG. 7A. Although the illustrated offset 116 is generally orthogonal in arrangement this is not a limitation as the offset can be formed so as to form other angles (e.g., 45 degrees) between the long axes of the notched and exposed ends of the tubular member 110*b*. It also should be recognized that the member 110 to which the scent pad 120 is removably secured to need not be cylindrical in form as other geometric shapes are contemplated for use with the present invention.

The use of this mounting device 100*a* can be best understood from the following discussion along with reference to FIGS. 1 and 5–7. As indicated above, the user takes the clamp member 102 and the base member 104 and position them such that the base member 104 is located below the barrel 12 of the gun 10. The user would then tighten the nuts 106 thereby clamping the barrel between the clamping member 102 and the base member 104. When so secured to the barrel 12, the clamp member 102 and the base member 104 do not interfere with the aiming sights of the weapon.

The user either before or after securing the clamping member 102 and base member 104 to the barrel 12 slides the portion of the tubular member 110 including the notch 112 into the middle portion through aperture 212 until the notch is positioned opposite the lower portion aperture 222. The threaded member 108 is then screwed into the base member 104 thereby securing the tubular member 110 with respect to the base member 104 at least so that the tubular member is restrained from moving or has limited motion along the long axis of the middle portion through aperture 212. In more specific embodiments, the tubular member 110 is secured within the base member 104 so as to resist or limit rotational motion of the tubular member as well as resisting or limiting linear motion along the long axis.

The user also secures the scent pad 120 to the exposed end 114 of the tubular member 110. Such securing of the scent pad 120 can be accomplished either before or after the tubular member 110 is secured to the base member 104 as described hereinabove. Further, and at an appropriate time, the user imbues the scent pad 120 with scent material, using any of a number of techniques either before or after the scent pad is secured to the tubular member 110. For example, the user applies deer urine to the scent pad 120 or places the scent pad in a container of deer urine until the scent pad is unable to absorb additional deer urine.

Thereafter, the scent is dispensed or dispersed to the air by normal movement of the weapon (e.g. gun) and/or the hunter or by deliberate waving or moving of the weapon by the hunter, thereby masking the scent, smell or odor of the hunter as well as those who maybe with him/her. Following or after concluding the hunting activities for the day or some other time period, the hunter removes the scent pad 120 from the tubular member 110. The removed scent pad 120 is stored for future use or is disposed of in an appropriate manner.

The foregoing process or securing a scent pad to the tubular member is repeated as and when needed. Because the mounting device 100*a*, tubular member 110 and scent pad 120 of the present invention yields a structure that is light weight and not bulky, a hunter can leave the mounting device 100*a* attached to the weapon without making the weapon unduly heavy or awkward to use during hunting.

Now referring to FIGS. 2, 5–6 and 8–9 there is shown a mounting device 100*b* that is configured so as to be removable attached or secured to a portion of the weapon as well as being configured so that a weapon hanger 130 is movable attached thereto. In more particular embodiments, the weapon hanger 130 also is configured and arranged so that a scent pad 120 also is removably attached thereto. Reference shall be made to the foregoing discussion regarding FIGS. 1 and 5–7 as well as the figures themselves for common features and functionalities not otherwise discussed or described below.

Figure 9:
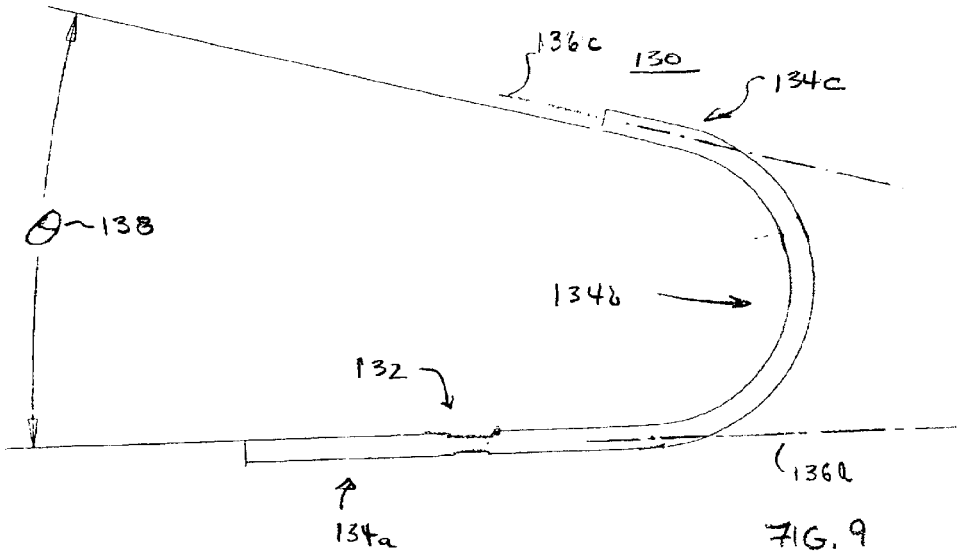
FIG. 9 is a plan view of an exemplary weapon hanger according to the present invention.

As more clearly shown in FIG. 9, in the illustrated embodiment the weapon hanger 130 is configured so as to generally form a J-hook type of hanger generally having first, second and third segments 134*a–c* thereof. It should be recognized, however, that the weapon hanger can be arranged so as to have any of a number of shapes and configurations known to those skilled in the art. The weapon hanger 130 is made up of any of a number of materials known to those skilled in the art, more particularly materials, such as aluminum, titanium or composite materials, that exhibit good structural characteristics while being of light weight.

The first segment 134*a* includes a notched region 132 that extends about the circumference thereof. As with the notch 112 in the tubular member 110, this notched region 132 is positioned within the base member 104 so as to oppose the lower portion aperture 222. The notch 132 is sized and arranged so as to restrain lateral motion along the long axis of the middle portion through aperture 212 as well as to mechanically engage the threaded member 108 so as to be capable of handling the loads imposed by the weight of a hanging gun/weapon. It also is within the scope of the present invention for such mechanical engagement to withstand other loads that may be imposed during hunting. In a particular embodiment, the notch 132 is sized so that the threaded member 108 mechanically engages the circumferential surfaces on the notch so the weapon hanger 130 does not rotate loosely within the middle portion through aperture 212 but can be moved by a user from a stored to the hanging position.

In a more particular embodiment, the weapon hanger 130 is configured so a long axis 136*c* of the third segment 134*c* ultimately intersects a long axis 136*a* of the first segment 134*a* where the point of intersection occurs outside the physical boundaries of the weapon hanger. More specifically, the intersection of the third segment long axis and the first segment long axis forms an angle in the range of from about 10 degrees to about 20 degrees, more particularly an angle of about 15 degrees. Such an arrangement yields a weapon hanger 130 that can be easily secured about and removed from a tree limb or branch.

In addition, and as illustrated, a scent pad 120 is securable to an exposed end of the first segment 134*a*. As with the tubular member 110, this exposed end can be configured and arranged with any of a number of surface artifacts or surface treatments known to those skilled in the art (e.g., knurling) that can be used to increase the mechanical engagement between the inner surface of the scent pad inner member 124 and the exposed and of the first segment 134*a*.

The use of this mounting device 100*b* in combination with a weapon hanger 130 can be best understood from the following discussion along with reference to FIGS. 1, 5–6, 8–9 and 11. As indicated above, the user takes the clamp member 102 and the base member 104 and positions them such that the base member 104 is located below the barrel 12 of the gun 10. The user then tightens the nuts 106 thereby clamping the barrel 12 between the clamping member 102 and the base member 104. When so secured to the barrel 12, the clamp member 102 and the base member 104 do not interfere with the aiming sights of the weapon.

The user either before or after securing the clamping member 102 and base member 104 to the barrel slides the weapon hanger first segment 134*a* into the middle portion through aperture 212 until the notch 132 is positioned opposite the lower portion aperture 222. The threaded member 108 is then screwed into the base member 104 thereby securing the weapon hanger 130 with respect to the base member 104 at least so that the weapon hanger is restrained from moving or has limited motion along the long axis of the middle portion through aperture 212. In more specific embodiments, the weapon hanger 130 is secured within the base member 104 so as to resist or limit rotational motion of the weapon hanger first segment 134*a* so that the weapon hanger 130 does not loosely rotate within the middle portion through aperture 212.

The user also secures a scent pad 120 to the exposed end of the weapon hanger first segment 134*a*. Such securing of the scent pad 120 can be accomplished either before or after the weapon hanger 130 is secured within the base member 104 as described hereinabove. Further, and at an appropriate time, the user imbues the scent pad 120 with scent material (e.g., deer urine), using any of a number of techniques either before or after the scent pad is secured to the weapon hanger first segment 134*a*. For example, the user applies deer urine to the scent pad 120 or places the scent pad in a container of deer urine until it is unable to absorb additional deer urine.

Thereafter, the scent is dispensed or dispersed to the air by normal movement of the weapon (e.g., gun) and/or the hunter or by deliberate waving or moving of the weapon by the hunter, thereby masking the scent, smell or odor of the hunter as well as those who maybe with him/her. Following or after concluding the hunting activities for the day or some other time period, the hunter removes the scent pad 120 from the weapon hanger 130. The removed scent pad 120 is stored for future use or is disposed of in an appropriate manner.

If a hunter wishes to temporarily hang a weapon such as a gun 10 from the branch 22 of a tree 20 or a man-made fixture (e.g., pole or structural member of a hunting blind), the hunter positions the open end of the hook end of the weapon hanger 130 about the branch or man-made fixture so that the arcuate or a second segment 134*b* of the weapon hanger contacts the branch or man-made fixture (see FIG. 11). In a more particular embodiment, the hunter also rotates the weapon hanger 130 within the middle portion through aperture 212 from a stored to an operational or hanging position prior to hanging of the weapon and performing the reverse steps after taking the weapon down.

The foregoing process or securing a scent pad 120 and/or hanging the weapon is repeated as and when needed. Because the mounting device 100*b*, the weapon hanger 130, and the scent pad 120 of the present invention yields a structure that is light weight and not bulky, a hunter can decide to leave the mounting member 100*b* and weapon hanger 130 attached to the weapon without making the weapon unduly heavy or awkward to use.

Now referring to FIGS. 3A, 5–6 and 10A, there is shown a mounting device 100*c* that is configured so as to be removable attached or secured to a portion of a weapon as well as being configured so that a recording device 140 also is removably attached thereto. The mounting device 100*c* includes a clamp member 102 and a base member 104 that are arranged so as to generally form an aperture there between in which is received the barrel 12 of the gun 10

(FIG. 11). As more particularly described herein, the clamp member 102 and base member 104 also are configured and arranged so that each are urged against and into mechanical engagement with the barrel 12. Reference also shall be made to the foregoing discussions regarding FIGS. 1–2 and 7–9 for other details of the mounting device 100*c* and components and functionalities thereof not otherwise discussed or described below. The recording device 140 is any of the number of portable recording devices known to those skilled in the art, including digital cameras, digital camcorders and the like. In a specific embodiment, the recording device 140 is any of a number of digital camcorders known to those skilled in the art.

The base member 104 is configured and arranged with a connector 224 that mechanically engages and is secured to one of the connectors provided with a conventional recording device 140, such as the connector 146 that is provided for mounting an external light to the recording device. In the illustrated embodiment, the middle portion 210 and the lower portion 220 are configured and arranged to form the structure comprising the connector 224, for example so as to form wing members that extend outwardly and lengthwise so as to engage the complementary structure of the connector 146 of a conventional recording device 140.

In a more specific embodiment, the mounting device 100*c* further includes an adapter 160 (FIG. 10B) that is used when using recording devices not having a connector detail that complements or corresponds to the connector 224 provided with the base member 104. The adapter 160 includes a first connector 162 that is configured and arranged to mechanically engage the connector 224 provided with the base member and a second connector 164 that is configured and arranged to mechanically engage a connector 146 of a given recording device. Such an adapter 160 preferably is made of a material having sufficient strength for the intended purpose yet light in weight such as those described above for the base member 104.

The use of this mounting device 100*c* in combination with a recording device 140 can be best understood from the following discussion along with reference to FIGS. 3, 5–6 and 10A. As indicated above, the user takes the clamp member 102 and the base member 104 and positions them such that the base member 104 is located below the barrel 12 of the gun 10. The user then tightens the nuts 106 thereby clamping the barrel 12 between the clamping member 102 and the base member 104. When so secured to the barrel 12, the clamp member 102 and the base member 104 do not interfere with the aiming sights of the weapon.

The user preferably also performs an alignment procedure so as to align the field of view of the recording device 140 with the weapon's aiming sights. After the mounting device 100*c* is secured to the barrel 12, the user mounts or secures the recording device 140 to the base member 104 as hereinabove described. Preferably, the weapon is mounted using any of a number of techniques known to those skilled in the art so that the targeted position of the aiming sights is fixed or repeatable. Using the rear viewfinder 144, the user determines if the area being targeted lies within the field of view of the lens assembly 142 of the recording device 140.

If the target area is not within the field view, the user loosens the mounting device 100*c* and repositions the mounting device until it is determined that the target area is within the field view. After aligning the target area and the field of view of the recording device 140, the user preferably makes a registration mark on the barrel 12 at a location next to the registration mark 230 (FIG. 5A) provided on the base member 104. In this way, the user can use the registration marks on the base member 104 and the barrel 12 to position the mounting device 100*c* so as to avoid the need to perform the above described alignment procedure. In this way, a hunter can remove the mounting device 100*c* while in the field to perform maintenance or some other action and still be able to align the target area and the field of view of the recording device 140.

When a hunter wishes to record their hunting experience, the hunter points or aims their weapon at a given target or quarry while the recording device 140 is operating. Because the field view of the recording device 140 has been aligning with the aiming sights of the weapon, the recording device lens assembly 142 is automatically aimed at the given target or quarry. Thus, a hunter can record their hunting experience without the need for other person or hunter to hold the recording device 130.

As indicated above, a mounting device 100*c* according to the present invention can be configured and arranged so that the recording device 140 can be used in conjunction with a scent pad 120 and/or a weapon hanger 130 as is illustrated in FIG. 3B. As such, the use of this mounting device 100*c* further includes the steps described above for securing the weapon hanger 130 and/or scent pad 120 to the mounting device 100*c*. It also is within the scope of the present invention, for the weapon in combination with the recording device 140 to be hung using the weapon hanger 130.

Now referring to FIGS. 4A, 5–6 and 10A, there is shown a mounting device 100*d* that is configured so as to be removable attached or secured to a portion of a weapon as well as being configured so that an illumination device 150 also is removably attached thereto. The mounting device 100*d* includes a clamp member 102 and a base member 104 that are arranged so as to generally form an aperture there between in which is received the barrel 12 of the gun 10 (FIG. 11). As more particularly described herein, the clamp member 102 and base member 104 also are configured and arranged so that each are urged against and into mechanical engagement with the barrel 12. In addition, the mounting device 100*d* includes an adapter 170 that is used to secure the illumination device 150 to the lower portion 220 of the base member 104.

Reference also shall be made to the foregoing discussions regarding FIGS. 1–3 and 7–9 and 10B for other details of the mounting device 100*c* and components and functionalities thereof not otherwise discussed or described below. The illumination device 150 is any of a number of devices known to those skilled in the art for generating a focused light output. The light output from the illumination device 150 can be in the visible range or in other frequency bands (e.g., infrared) as is known to those skilled in the art and appropriate for the intended use. In a particularly illustrative embodiment, the illumination device 150 is a flashlight emitting a focused light beam in the visible range.

The base member 104 is configured and arranged with a connector 224 that mechanically engages and is secured to a first connector 172 of an adapter 170. As indicated above, it is desirous to configure the base member 104 so that a recording device 140 can be secured thereto. As such, the adapter first connector 172 preferably also is configured and arranged so as to have a corresponding structure of one of the connectors provided with a conventional recording device 140, such as a connector 146 that is provided for mounting an external light to the recording device.

In addition to the first connector 172, the adapter 170 further includes a second connector 174 to which the illumination device 150 is secured. In the illustrated embodiment, the second connector 174 also is configured so as to have a shape that complements the surface of the illumination device 150 (i.e., flashlight) the adapter 170 is to be secured to.

The second connector 174 can further include any of a number of mechanisms or utilize any of a number of techniques known to those skilled in the art for securing the adapter second connector 174 to the illumination device 150. For example, the adapter second connector 174 is configurable so that the adapter second connector is adhesively secured to the exterior surface of the illumination device 150. In another embodiment, the adapter second connector 174 is mechanically secured to the exterior surface of the illumination device 150 for example by screws. In yet another embodiment, when the illumination device 150 embodies a magnetic material outer structure, the adapter second connector 174 is secured to the illumination device by lightweight permanent magnets embodied in the adapter proximal the second connector. Such an adapter 170 preferably is made of a material having sufficient strength for the intended purpose yet light in weight and other wise appropriate for the intended use such as plastic, aluminum and the like.

The use of this mounting device 100*d* in combination with an illumination device 150, more particularly a flashlight, can be best understood from the following discussion along with reference to FIGS. 4A, 5–6 and 10A. As indicated above, the user takes the clamp member 102 and the base member 104 and positions them such that the base member 104 is located below the barrel 12 of the gun 10. The user then tightens the nuts 106 thereby clamping the barrel 12 between the clamping member 102 and the base member 104. When so secured to the barrel 12, the clamp member 102 and the base member 104 do not interfere with the aiming sights of the weapon.

The user preferably also performs an alignment procedure so as to align the light output beam of the illumination device 150, such as a flashlight, with the weapon's aiming sights. After the mounting device 100*d* is secured to the barrel 12, the user mounts or secures the illumination device 150 to the base member 104 as hereinabove described. Preferably, the weapon is mounted using any of a number of techniques known to those skilled in the art so that the targeted position of the aiming sights is fixed or repeatable. The user then observes to see if the light from the illumination device 150 is illuminating the target area.

If the target area is not being illuminated, the user loosens the mounting device 100*d* and repositions the mounting device until it is determined that the target area is being illuminated by the light coming from the illumination device 150. After aligning the target area with the light from the illumination device 150, the user preferably makes a registration mark on the barrel 12 at a location next to the registration mark 230 (FIG. 5A) provided on the base member 104. In this way, the user can use the registration marks on the base member 104 and the barrel 12 to position the mounting device 100*d* so as to avoid the need to perform the above described alignment procedure. In this way, a hunter can remove the mounting device 100*c* while in the field to perform maintenance or some other action and still be able to align the target area and light coming from the output end 152 of the illumination device 150.

When a hunter wishes to illuminate the target area using the illumination device 150 (e.g., flashlight), the hunter points or aims their weapon at a given target or quarry while the illumination device is on or after depressing the on/off switch 154. Because the illumination device 150 has been aligning with the aiming sights of the weapon, the illumination device assuming that the illumination device has sufficient power should automatically illuminate the target area.

As indicated above, a mounting device 100*d* according to the present invention can be configured and arranged so that the illumination device 150 can be used in conjunction with a scent pad 120 and/or a weapon hanger 130 as is illustrated in FIG. 4B. As such, the use of this mounting device 100*d* further includes the steps described above for securing the weapon hanger 130 and/or scent pad 120 to the mounting device 100*d*. It also is within the scope of the present invention, for the weapon in combination with the illumination device 150 (e.g., flashlight) to be hung from a tree 20 (FIG. 11), etc using the weapon hanger 130.

Although a preferred embodiment of the invention has been described using specific terms, such description is for illustrative purposes only, and it is to be understood that changes and variations may be made without departing from the spirit or scope of the following claims.

What is claimed is:

1. An accessory mounting device for removably securing a weapon hanger to a weapon, the weapon hanger including a shaft portion and a hanger portion secured to the shaft portion, said accessory mounting device comprising:

a clamping device being configured and arranged so as to be removably secured to a portion of the weapon;

wherein the clamping device includes:

a first member that is configured and arranged so as to extend downwardly from a top surface of the weapon portion and about side surfaces of the weapon portion, where a segment of the first member is arranged so as to complement a shape of the weapon portion top surface, a second member including a region that is configured so as to complement a shape of a lower surface of the weapon portion, wherein the first member is removably secured to the second member, whereby the clamping device is removably secured to the weapon portion; and wherein said clamping device second member is configured and arranged so the weapon hanger shaft portion is secured thereto and arranged so the weapon hanger does not interfere with the aiming sights of the weapon and so the weapon hanger shaft portion extends generally parallel to and along a longitudinal axis of the weapon portion and go the hanger portion is extendable outwardly from the weapon portion, whereby the hanger portion is positioned so as to be capable of being hung from one of a naturally occurring feature or a man-made fixture.

2. The accessory mounting device of claim 1, wherein the clamping device first member is configured and arranged so as to not interfere with the aiming sights of the weapon, when the clamping device is secured to the weapon portion.

3. The accessory mounting device of claim 1, wherein the clamping device second member is configured and arranged so that the weapon hanger is selectively, movably disposed within an aperture disposed in the clamping device second member.

4. The accessory mounting device of claim 1, wherein a scent generating mechanism is secured to a portion of the weapon hanger.

5. The accessory mounting device of claim 1, wherein the hanger portion of the weapon hanger comprises first, second and third segments being interconnected to each other, the first segment being an extension of the shaft member, wherein the second segment is arcuate and said first, second and third segments are configured and arranged to form a hook like structure, and wherein the second and third segments are formed so a long axis of the third segment intersects a long axis of the first segment.

6. The accessory mounting device of claim 5, wherein the angle of intersection between the long axis of the first and third segments is in the range of from about 10 to 20 degrees.

7. A method for hunting with a weapon comprising the steps of:

providing a mounting device for a weapon hanger having a shaft portion and a hanger portion, the mounting device including a first member that is configured and arranged so as to extend downwardly from a top surface of a portion of the weapon and about side surfaces of the weapon portion, where a segment of the first member is arranged so as to complement a shape of the weapon portion top surface, and a second member including a region that is configured so as to complement a shape of a lower surface of the weapon portion;

securing the weapon hanger shaft portion to the second member, wherein the provided second member is configured and arranged so the weapon hanger is securable thereto and arranged so as to not interfere with the aiming sights of the weapon; and removably securing the first member to the second member and about a portion of the weapon, whereby the mounting device is removably secured to the weapon portion, wherein the provided securing member is configured and arranged so that the weapon hanger shaft portion extends generally parallel to and along a longitudinal axis of the weapon portion when the mounting device is thus secured to the weapons portion.

8. The method for hunting according to claim 7, further comprising the step of:

hanging the hunting weapon from one of a naturally occurring or man-made fixture using the hanger portion of the weapon hanger.

9. An accessory mounting device for a weapon in combination with a weapon hanger having a shaft portion and a hanger portion, comprising:

a clamping device being configured and arranged so as to be removably secured to a portion of the weapon;

wherein the clamping device includes:

a first member that is configured and arranged so as to extend downwardly from a top surface of the weapon portion and about side surfaces of the weapon portion, where a segment of the first member is arranged so as to complement a shape of the weapon portion top surface, a second member including a region that is configured so as to complement a shape of a lower surface of the weapon portion, and wherein the first member is removably secured to the second member, whereby the clamping device is removably secured to the weapon portion;

wherein said clamping device second member is configured and arranged so the weapon hanger is secured thereto and arranged so as to not interfere with the aiming sights of the weapon and so the weapon hanger shaft portion extends generally parallel to and along a longitudinal axis of the weapon portion and so the hanger portion is extendable outwardly from the weapon portion, whereby the hanger portion is positioned so as to be capable of being hung from one of a naturally occurring feature or a man-made fixture.

10. An accessory mounting device for removably securing a weapon hanger to a weapon, comprising:

a scent generating mechanism that is secured to a portion of the weapon hanger;

a clamping device being configured and arranged so as to be removably secured to a portion of the weapon; and wherein the clamping device includes:

a first member that is configured and arranged so as to extend downwardly from a top surface of the weapon portion and about side surfaces of the weapon portion, where a segment of the first member is arranged so as to complement a shape of the weapon portion top surface, a second member including a region that is configured so as to complement a shape of a lower surface of the weapon portion, wherein the first member is removably secured to the second member, whereby the clamping device is removably secured to the weapon portion, and wherein said clamping device second member is configured and arranged so the weapon hanger is secured thereto and arranged so the weapon hanger does not interfere with the aiming sights of the weapon.

11. The accessory mounting device of claim 10, wherein the scent generating mechanism comprises an absorbent material that receives the scent material.

12. The accessory mounting device of claim 11, wherein the absorbent material is an oleophillic absorbent material.

* * * * *